US008028554B2

(12) United States Patent
Amir

(10) Patent No.: US 8,028,554 B2
(45) Date of Patent: Oct. 4, 2011

(54) ELECTRONIC CYLINDER LOCK APPARATUS AND METHODS

(75) Inventor: Haim Amir, Ramat Hasharon (IL)

(73) Assignee: Essence Security International Ltd., Herzlia (IL)

( * ) Notice: Subject to any disclaimer, the term of this patent is extended or adjusted under 35 U.S.C. 154(b) by 442 days.

(21) Appl. No.: 11/469,865

(22) Filed: Sep. 3, 2006

(65) Prior Publication Data

US 2008/0053174 A1 Mar. 6, 2008

(51) Int. Cl.
*E05B 47/00* (2006.01)

(52) U.S. Cl. ..... 70/278.7; 70/279.1; 70/375; 70/493

(58) Field of Classification Search ..... 70/375, 70/372, 373, DIG. 39, 391, DIG. 73, 408, 70/252, 454, 493–495, 276, 277, 278.3, 278.7, 70/279.1, 283.1
See application file for complete search history.

(56) References Cited

U.S. PATENT DOCUMENTS

| | | | | | |
|---|---|---|---|---|---|
| 756,830 | A | * | 4/1904 | Caley | 70/397 |
| 1,060,769 | A | * | 5/1913 | Kohlberger | 70/493 |
| 1,393,006 | A | * | 10/1921 | Block | 70/127 |
| 1,455,577 | A | * | 5/1923 | Epstein | 70/419 |
| 1,579,119 | A | * | 3/1926 | Kloss | 74/557 |
| 1,896,319 | A | * | 2/1933 | Littell et al. | 70/382 |
| RE20,639 | E | * | 1/1938 | Price | 70/353 |
| 2,755,656 | A | * | 7/1956 | Schwartz | 70/493 |
| 2,836,973 | A | * | 6/1958 | Schillizzi | 70/421 |
| 3,059,462 | A | * | 10/1962 | Check | 70/384 |
| 3,149,486 | A | * | 9/1964 | Russell et al. | 70/384 |
| 3,889,501 | A | | 6/1975 | Fort | |
| 4,018,465 | A | * | 4/1977 | Ramler | 292/336.3 |
| 4,026,134 | A | * | 5/1977 | Woolfson | 70/276 |
| 4,068,507 | A | * | 1/1978 | Peterson | 70/271 |
| 4,195,504 | A | * | 4/1980 | Foshee | 70/369 |
| 4,228,669 | A | * | 10/1980 | Bischoff | 70/379 R |
| 4,328,693 | A | * | 5/1982 | Lipschutz | 70/431 |
| 4,426,864 | A | * | 1/1984 | Morikawa | 70/431 |
| 4,689,989 | A | * | 9/1987 | Aslesen et al. | 73/61.44 |
| 4,745,785 | A | * | 5/1988 | Uebersax | 70/279.1 |
| 4,761,977 | A | * | 8/1988 | Weatherby | 70/493 |
| 4,850,210 | A | * | 7/1989 | Adler et al. | 70/383 |
| 5,018,375 | A | * | 5/1991 | Tully | 70/472 |
| 5,600,980 | A | * | 2/1997 | Fabian | 70/408 |
| 5,623,844 | A | * | 4/1997 | Draeger | 70/408 |
| 5,752,400 | A | * | 5/1998 | Kim | 70/368 |
| 5,839,305 | A | | 11/1998 | Aston | |
| 5,870,915 | A | * | 2/1999 | D'Hont | 70/278.3 |

(Continued)

*Primary Examiner* — Lloyd Gall
(74) *Attorney, Agent, or Firm* — Mark M. Friedman

(57) ABSTRACT

A cylinder lock device including: a body housing having a bore, with a direction of elongation defining an axial direction for the device; a rotatable cylindrical plug in the bore, the plug having an axially extending key slot from at least one end of the plug; a plurality of driver pins configurable substantially perpendicular to the key slot and located within the body housing and substantially outside of the plug; a plurality of tumbler pins corresponding to and positionable substantially collinear with each one of the plurality of driver pins and substantially inside the plug, the tumbler pins displaceable by a key to bias the driver pins to enable rotation of the plug, the driver pins adapted to displace the respective tumbler pins; and a displacement mechanism being deployed within the body housing and adapted to displace the plurality of driver pins thereby selectively enabling rotation of the plug when no key is present in the slot.

11 Claims, 13 Drawing Sheets

U.S. PATENT DOCUMENTS

| | | | | |
|---|---|---|---|---|
| 5,956,984 | A * | 9/1999 | Hughes | 70/394 |
| 6,035,492 | A * | 3/2000 | Warshaviak | 292/336.3 |
| 6,047,577 | A * | 4/2000 | Klimas | 70/340 |
| 6,147,622 | A | 11/2000 | Fonea | |
| 6,523,377 | B1 * | 2/2003 | Vonlanthen | 70/278.3 |
| 6,564,601 | B2 | 5/2003 | Hyatt, Jr. | |
| 6,698,264 | B1 * | 3/2004 | Liao | 70/493 |
| 7,146,834 | B2 * | 12/2006 | Bull et al. | 70/454 |
| 7,308,811 | B2 * | 12/2007 | Armstrong et al. | 70/492 |
| 2002/0124610 | A1 * | 9/2002 | Harwood | 70/278.3 |
| 2004/0040355 | A1 * | 3/2004 | Goldman | 70/278.3 |

* cited by examiner

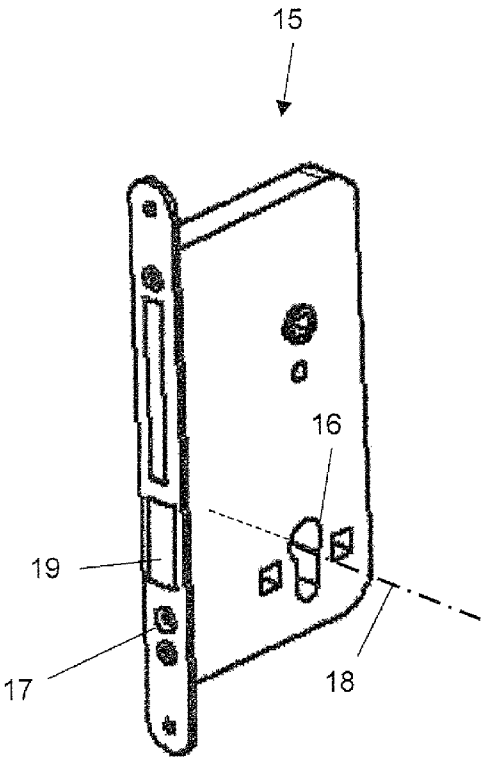
FIG. 1B – PRIOR ART
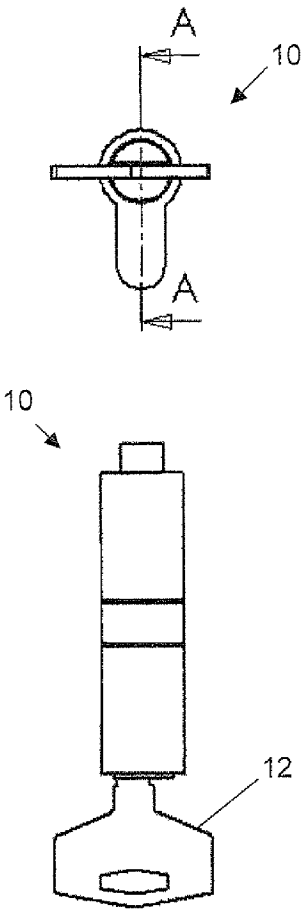
FIG. 1A – PRIOR ART

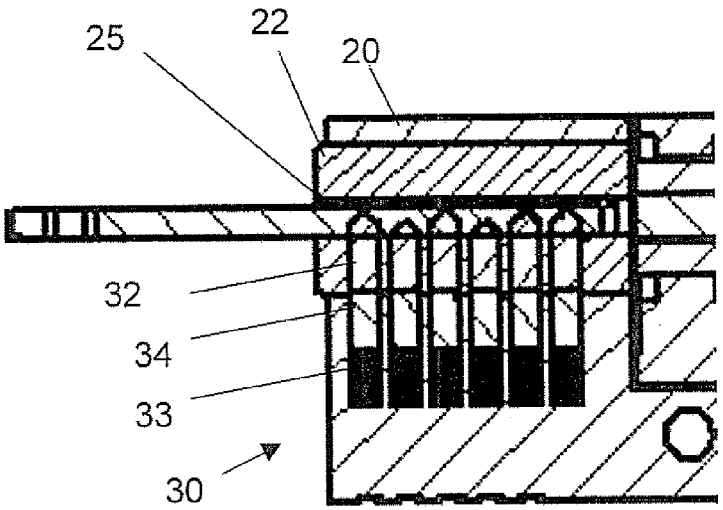
FIG. 2B – PRIOR ART
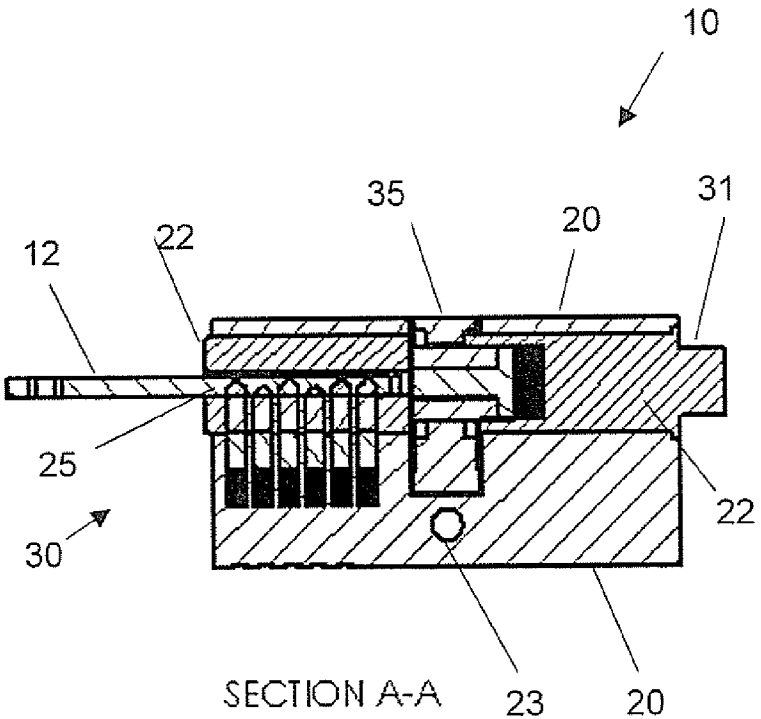
FIG. 2A – PRIOR ART

DETAIL F

ELECTRONIC CYLINDER LOCK APPARATUS AND METHODS

FIELD AND BACKGROUND OF THE INVENTION

The present invention relates to cylinder locks and, in particular, it concerns a cylinder lock apparatus that can be operated with or without a key.

In a conventional mechanical cylinder lock, when an appropriate matching key is inserted into the cylinder lock, the key serves to mechanically align tumbler pins, and thereby allowing the cylindrical plug to be rotated freely to open the lock. Referring now to FIGS. 1A and 1. B, which are representations of a prior art cylinder lock 10, with a key 12 inserted into the cylinder lock, and a door lock 15. Door lock 15 includes, inter alia, a shaped slot 16 for receiving cylinder lock 10 and a door lock bolt hole 17 through which a bolt (not shown) is inserted to secure the cylinder lock inside a door. Typically, door lock 15 is inserted into a hollowed-out edge of the door (not shown) and cylinder lock 10 is inserted through prepared holes in the door (not shown in the figure) and perpendicularly into and through shaped slot 16, substantially along axis 18. Door lock further comprises a locking tongue 19. Typically, cylinder lock 10, when unlocked, serves to translate locking tongue 19 allowing the tongue to alternately inhibit and allow opening of the door. Typically, other cylinder locks having a cross-sectional profile and length substantially matching cylinder lock 10 may be replaced or retrofitted instead of cylinder lock 10. Typical names/manufacturers of such cylinder locks include, but are not limited to: Euro Cylinders; Oval Cylinders; Asec 6-pin Euro profile; and Chubb M3. Overall lengths of such cylinders typically vary from approximately 70-95 mm.

Reference is now made to FIGS. 2A and 2B, which are cross sectional side views A-A of the cylinder lock shown in FIG. 1A. The cylinder lock has a body housing 20, which is bored from one end to the other end and a cylindrical plug 22, which is fitted into the bore, and which may be rotated, as described hereinbelow. A set hole 23 is located approximately in the middle of cylinder lock 10 to receive a bolt which is inserted into door lock bolt hole 17, to secure the cylinder lock within door lock 15, as described hereinabove in FIG. 1B. Cylindrical plug 22 has a key slot 25 formed axially in cylindrical plug. Key 12 is inserted into slot 25. A pin-tumbler set 30 is located in body housing 20 and in cylindrical plug 22 to serve to lock and unlock rotational movement of cylindrical plug 22. Cylindrical plug 22 and a second cylindrical plug 31 may be mechanically coupled and uncoupled to a rotating tongue 35 by means of a selector mechanism (not shown in the figure), which allows either cylindrical plugs to rotate the rotating tongue, which in turn serves to move the locking tongue of the door lock (refer to FIG. 1B). The cylinder lock shown in FIGS. 2A and 2B is called a "blind cylinder", meaning that a key can be inserted into only one side of the lock, with only one pin-tumbler set present, and that the other side of lock cannot accept a key. However, cylinder lock 10 may also comprise pin-tumbler sets in respective cylindrical plugs at both ends.

FIG. 2B, which is a detailed view of FIG. 2A, shows in greater detail pin-tumbler set 30. Pin-tumbler set 30 includes tumbler pins 32 and driver pins 34, both of which are constrained to move generally perpendicularly to key 12. Springs 33 typically serve to preload the driver pins and the tumbler pins, displacing them towards slot 25, thereby advancing part of one or more of driver pins 34 into cylindrical plug 22 through openings in the plug (not shown in the figure) and thereby locking rotation of cylindrical plug 22 when no key is present in the slot. Typically, key 12 is formed to fit the pattern and respective lengths of tumbler pins 32. When key 12 is fully inserted into slot 25, the key presses tumbler pins 32 and driver pins 34 against springs 33, alignedly inserting driver pins 34 into body housing 20, and thereby enables rotation of the cylindrical plug. Whereas key 12 is shown inserted, with its wider traverse edge contacting the tumbler pins, another inserted orientation of key 12 may include its thinner traverse edge contacting the tumbler pins. Also, one or more additional sets of collinearly arranged tumbler pins (not shown) may be present, in the case of a master key, which is used to lock and unlock a number of such specially configured cylinder locks.

A number of prior art electronic or combination electrical/mechanical lock systems allow a user to open a locked cylinder in a number of ways. In U.S. Pat. No. 3,889,501 by Fort, whose disclosure is incorporated herein by reference, a combination electrical and mechanical system is described. The system includes a lock having a fixed lock cylinder and a rotatable key slug. A first solenoid is employed in the current system to drive a lock pin, which is normally extended to lock the key slug. Upon insertion of an appropriately aperture-encoded key, light sources and detectors mounted in the lock are used in concert with appropriate circuitry to operate to the first solenoid to unlock key slug. A second solenoid is operable, in response to an electrical power failure, to extend a latch pin. When the latch pin is extended a proper mechanical key is inserted and rotated, extension of the lock pin is prevented. A proper mechanical key can be inserted to move a plurality of spring loaded pin tumblers in the lock to enable rotation of the key slug during an electrical power failure.

Aston, in U.S. Pat. No. 5,839,305 whose disclosure is incorporated herein by reference, discloses an electrically operable cylinder lock device, which includes a body with a bore housing a rotatable barrel, having a key slot. The device has an electromagnet, which is employed to interact with a detent bar, the detent bar positioned to alternately inhibit or enable, with the aid of the electromagnet, rotation of the rotatable barrel. Another embodiment disclosed by Aston has a microswitch which interacts with an inserted key and controls the supply of electrical power.

While the prior art includes an array of combination electrical/mechanical lock systems of varying complexity, there is a need for an electronic or combination electrical/mechanical cylinder lock that, taking advantage of the inherent cylinder pin tumbler mechanism, can be unlocked or unlocked without the insertion of a key, while also functioning as a conventional lock operated with a key in case of an electrical power failure.

SUMMARY OF THE INVENTION

The present invention is a combined electrical/mechanical cylinder lock that, taking advantage of the inherent pin tumbler mechanism, can be unlocked or unlocked without the insertion of a key, while also functioning as a conventional lock operated with a key in case of an electrical power failure.

According to the teachings of the present invention there is provided, a cylinder lock device including: a body housing having a bore, with a direction of elongation defining an axial direction for the device; a rotatable cylindrical plug in the bore, the plug having an axially extending key slot from at least one end of the plug; a plurality of driver pins configurable substantially perpendicular to the key slot and located within the body housing and substantially outside of the plug; a plurality of tumbler pins corresponding to and positionable substantially collinear with each one of the plurality of driver pins and substantially inside the plug, the tumbler pins displaceable by a key to bias the driver pins to enable rotation of the plug, the driver pins adapted to displace the respective tumbler pins; and a displacement mechanism being deployed within the body housing and adapted to displace the plurality of driver pins thereby selectively enabling rotation of the plug when no key is present in the slot.

Most preferably, the key slot extends substantially radially to the side of the plug, forming a lateral opening in the plug and wherein the cylinder lock further comprises a fitted inhibitor adapted to cover the lateral opening so that the plurality of displacer pins do not enter the lateral opening and thereby do not serve to inhibit disruption of rotation of the rotatable cylindrical plug. Preferably, the displacement mechanism is adapted to controllably displace the plurality of driver pins between a first state in which the plurality of driver pins are biased towards the key slot to provide a locked state and a second state in which the plurality of driver pins are aligned to allow rotation of the cylindrical plug.

Typically, the displacement mechanism includes a first artificial muscle unit adapted to selectively displace the respective plurality of driver pins. Preferably, the displacement mechanism includes an electromagnetic assembly, wherein the electromagnetic assembly comprises a controllable magnetic pole configuration to selectively displace the respective plurality of driver pins to allow the respective plurality of driver pins to be selectively displaced. Typically, the displacement mechanism includes a magnetic unit, wherein the magnet unit includes a magnetic pole configuration to allow the respective plurality of driver pins to be selectively displaced. Most preferably, the displacement mechanism includes a mechanical linkage, the mechanical linkage driven by a linkage driver selected from the group consisting of: a second artificial muscle unit; a linear motor assembly, a rotational motor assembly, and an electromagnetic assembly.

Most preferably, a rotatable tongue is positionable substantially axially with and at the interior end of the first rotatable plug and having an axial engager enabling the rotatable tongue to rotate with the first plug; a second rotatable cylindrical plug is in the bore, the axial engager enabling the rotatable tongue to rotate with the second plug; and a selector mechanism is adapted to selectively engage and disengage the axial engager when a key is present in the slot and when no key is present in the slot, the selector mechanism being adapted to preferentially engage the axial engager, enabling the rotatable tongue to rotate with the first plug. Preferably, the selector mechanism is further adapted to engage the axial engagement and to rotate the first plug when a key is present in the slot, after the rotatable tongue has been rotated by the second plug. Typically, the selector mechanism is mechanically, electrically, and mechanically and electrically actuable. Most typically, the body housing dimensions are substantially identical to at least one of the following cylinder lock standards: Euro Cylinder; Oval Cylinder; Asec 6-pin Euro profile; and Chubb M3.

There is further provided a cylinder lock device including a body housing having a bore, with a direction of elongation defining an axial direction for the device; a rotatable cylindrical plug in the bore, the plug having an axially extending key slot from at least one end of the plug; and a mechanically accessible handle permanently mechanically linked to the plug at the end of the plug having the slot, the handle adapted to rotate the plug when the plug is freed to rotate and when no key is present in the slot. Most preferably, the handle is adapted to allow insertion and removal of a key from the slot. Preferably, the handle is further adapted to be hinged, so that the handle is stowed substantially perpendicular to axis of the plug and deployed substantially parallel to the axis of the plug.

There is further provided a method of forming a cylinder lock device comprising the steps of: forming a bore in a body housing of the cylinder lock device, the body housing having a direction of elongation defining an axial direction for the device; inserting a rotatable cylindrical plug in the bore, the plug having an axially extending key slot from at least one end of the plug; configuring a plurality of tumbler pins in the plug, whereby a key displaces the tumbler pins to enable rotation of the plug; positioning a plurality of driver pins, corresponding to and substantially collinear with each one of the plurality of tumbler pins and locatable distally from the slot and from the plurality of tumbler pins, adapted to displace the respective tumbler pins; and deploying a displacement mechanism within the body housing to displace the plurality of driver pins thereby enabling or disabling rotation of the plug when no key is present in the slot. Most preferably, the method further includes the steps of: positioning a rotatable tongue substantially axially with and at the interior end of the first rotatable plug, and having an axial engager enabling the rotatable tongue to rotate with the first plug; inserting a second rotatable cylindrical plug in the bore, the axial engager enabling the rotatable tongue to rotate with the second plug; and configuring a selector mechanism to selectively engage and disengage the axial engager when a key is present in the slot and when no key is present in the slot, the selector mechanism preferentially engaging the axial engager, enabling the rotatable tongue to rotate with the first plug.

There is further provided a method of forming a cylinder lock device comprising the steps of: forming a bore in a body housing of the cylinder lock device, the body housing having a direction of elongation defining an axial direction for the device; inserting a rotatable cylindrical plug in the bore, the plug having an axially extending key slot from at least one end of the plug; and configuring a mechanically accessible handle permanently mechanically linked to the plug at the end of the plug having the slot, whereby the handle serves to rotate the plug when the lock is unlocked and when no key is present in the slot.

BRIEF DESCRIPTION OF THE DRAWINGS

The invention is herein described, by way of example only, with reference to the accompanying drawings, wherein:

FIGS. 1A and 1B are representations of a prior art cylinder lock and a door lock, respectively;

FIGS. 2A and 213 are cross sectional side views of the cylinder lock shown in FIGS. 1A and 113;

DESCRIPTION OF PREFERRED EMBODIMENTS

The present invention includes a lock apparatus that may be opened with or without a key and methods thereof.

Figure 3:
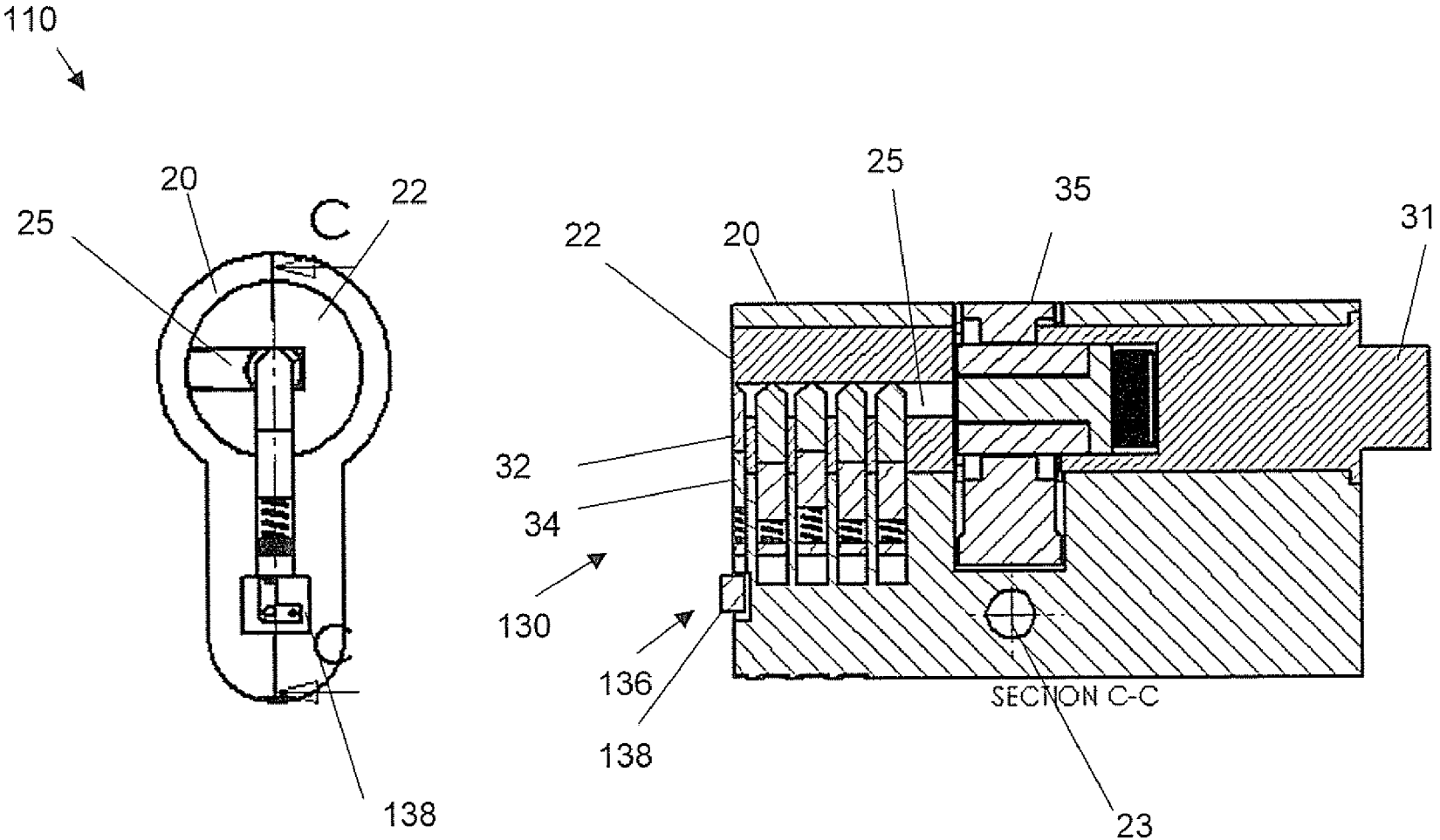
FIG. 3 is an end view and a cross sectional view of a cylinder lock with magnetic displacement of the pin-tumbler set, in accordance with of an embodiment of the present invention.
Figure 6A:
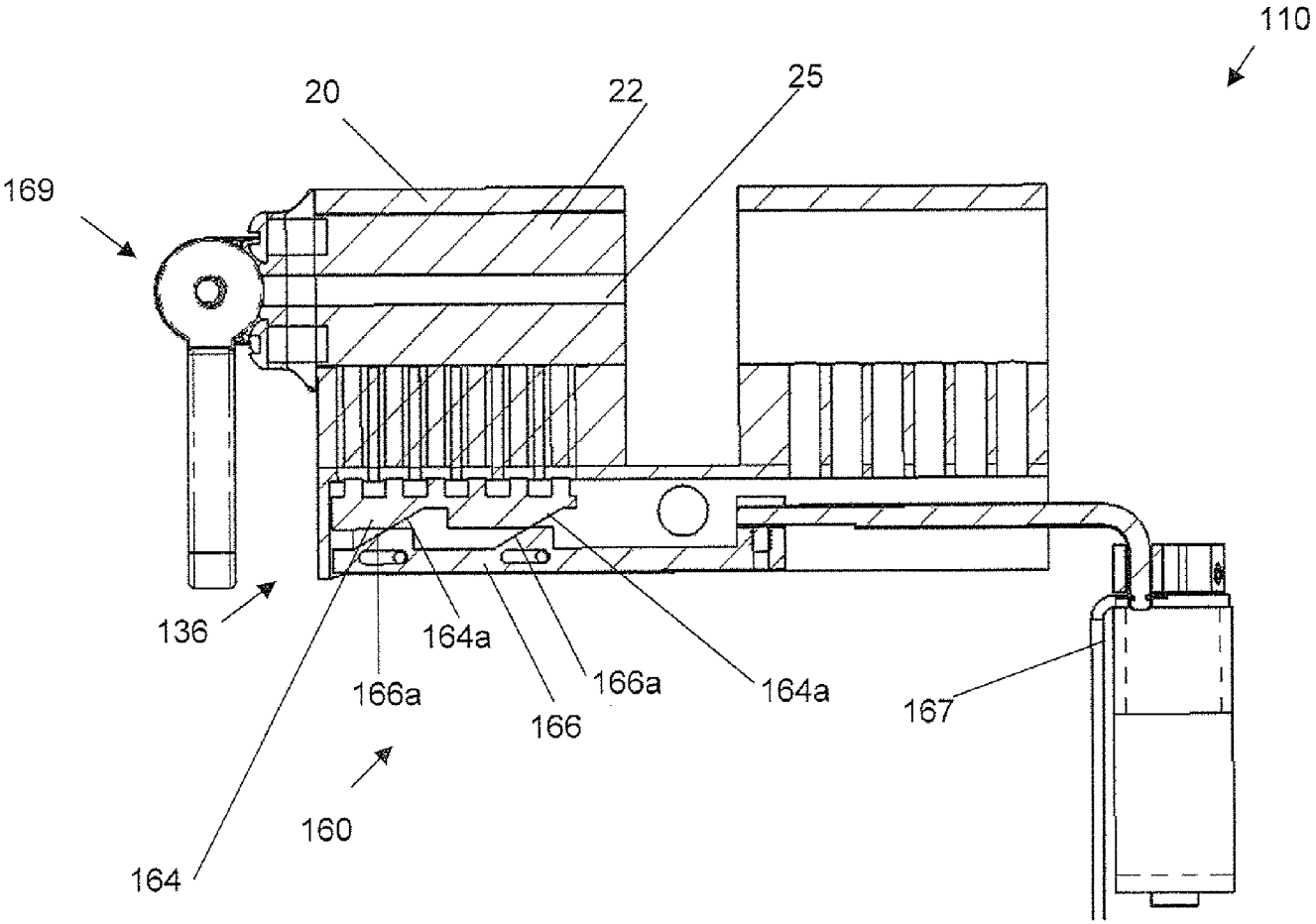
FIGS. 6A-C are cross-sectional, representative, and cross sectional views, respectively, of the cylinder lock of FIG. 3, having a mechanical linkage assembly displacement of the pin-tumblers and having a cylindrical plug rotational handle, in accordance with embodiments of the present invention.
Figure 6B:
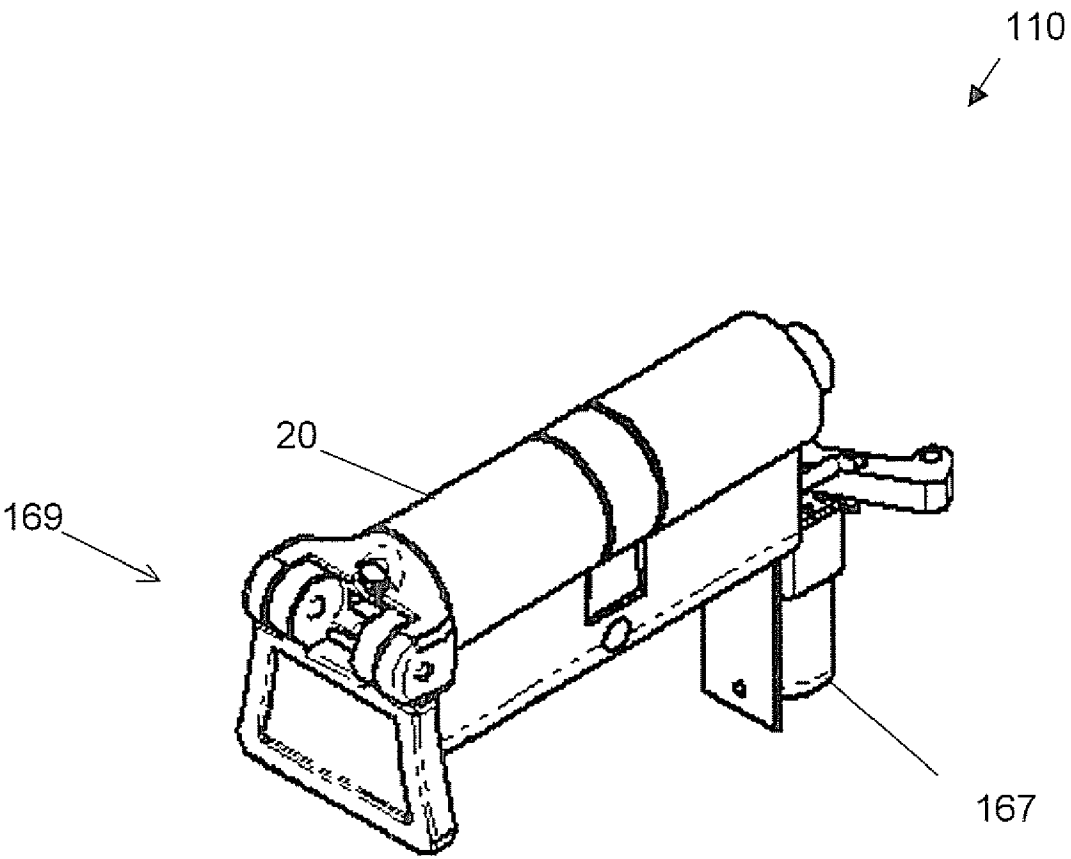
Figure 6C:
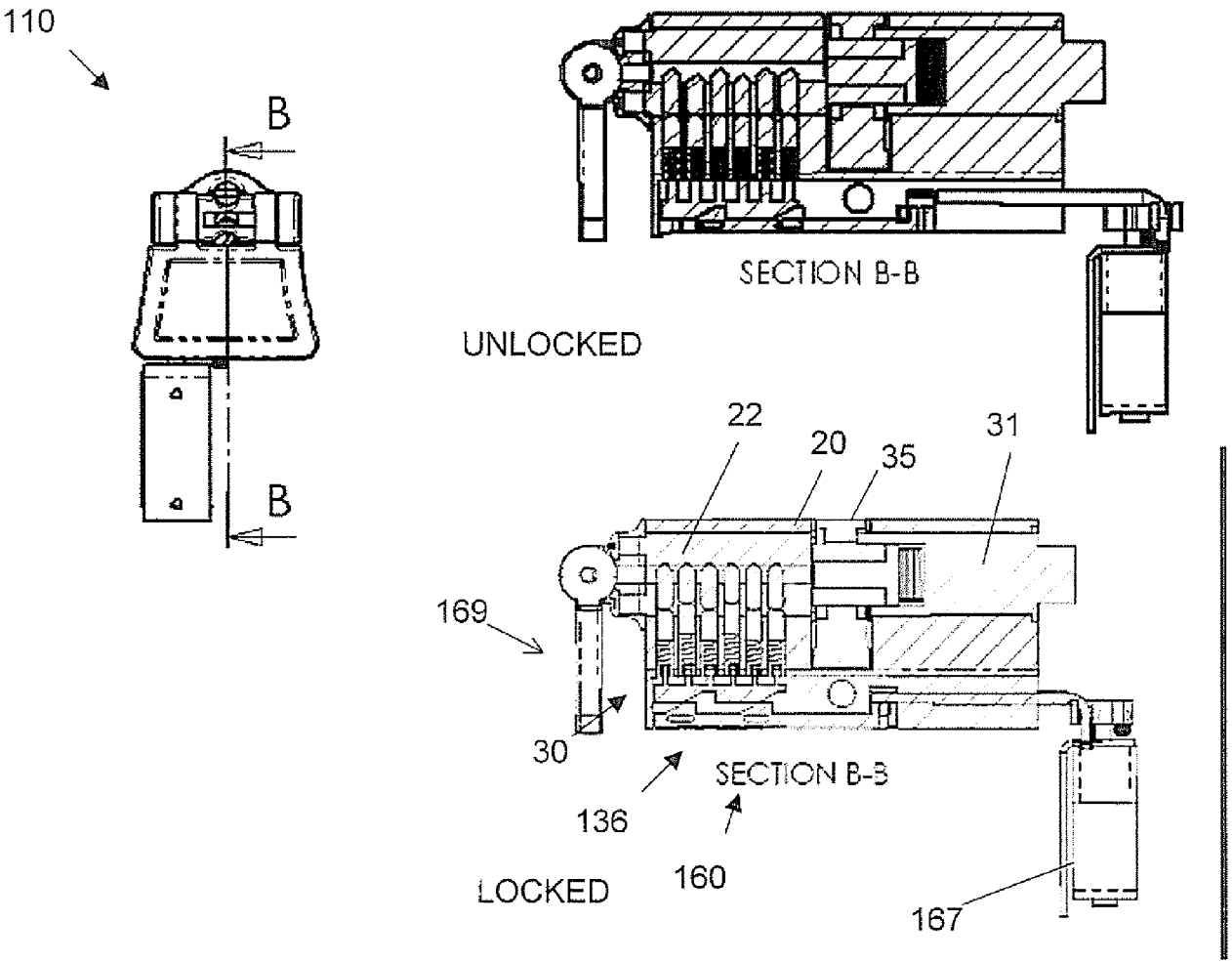

Reference is now made to FIG. 3, 4, 5A, 5B, and, which are end and cross sectional views of cylinder lock 110, and to FIGS. 6A-C, which are cross-sectional, representative, and cross sectional views, respectively, of cylinder lock 110, in accordance with embodiments of the present invention. Apart from differences described below, cylinder lock 110 is generally similar to operation of cylinder lock 10 as shown in FIGS. 2A and 2B, so that elements indicated by the same reference numerals are generally identical in configuration and operation. Embodiments of the current invention disclosed hereinbelow are directed to be generally replaceable to cylinder lock 10 and/or retrofittable to cylinder lock 10 in door lock 15 shown in FIGS. 1A, 1B, 2A, and 2B.

A pin displacement mechanism 136 is located in body housing 20 to displace tumbler pins 32 and driver pins 34. Pin displacement mechanism 136 comprises one or more configurations as shown in FIGS. 3, 4, 5A, 5B, 6A, and 6C, to preload driver pins 34 and tumbler pins 32 towards slot 25 when no key is present, thereby advancing part of one or more of driver pins 34 into cylindrical plug 22 and locking rotation of cylindrical plug 22. Alternatively, pin displacement mechanism 136 may be activated to displace driver pins 34 into body housing 20, thereby aligning them so as to enable rotation of the cylindrical plug, even when no key is inserted into slot 25.

The term "axial" and "axially", as used hereinbelow and in the claims is meant to describe a configuration generally parallel to an axis. Additionally, the terms "open" and "closed, when used hereinbelow and in the claims in reference to a state of the cylinder lock, are meant to describe the respective states whereby plug rotation is enabled and disabled.

Pin displacement mechanism 136 may comprise a magnetic unit 138, as shown in FIG. 3. Magnetic unit 138 includes a series of rotatable permanent magnets (of which one is shown in the figure), corresponding to respective driver pins 34. Dependant on the respective polarities of the individual magnets, respective magnets serve to displace respective driver pins towards and away from slot 25. Polarities of respective magnets of magnetic unit 138 may be configured in a non-uniform configuration to obviate magnetic "picking" of cylinder lock 110, such as when an external magnetic field is applied to the cylinder, in an attempt to open the cylinder lock. Magnetic unit 138 includes a driver (not shown in the figure) for rotating respective magnets.

Figure 4:
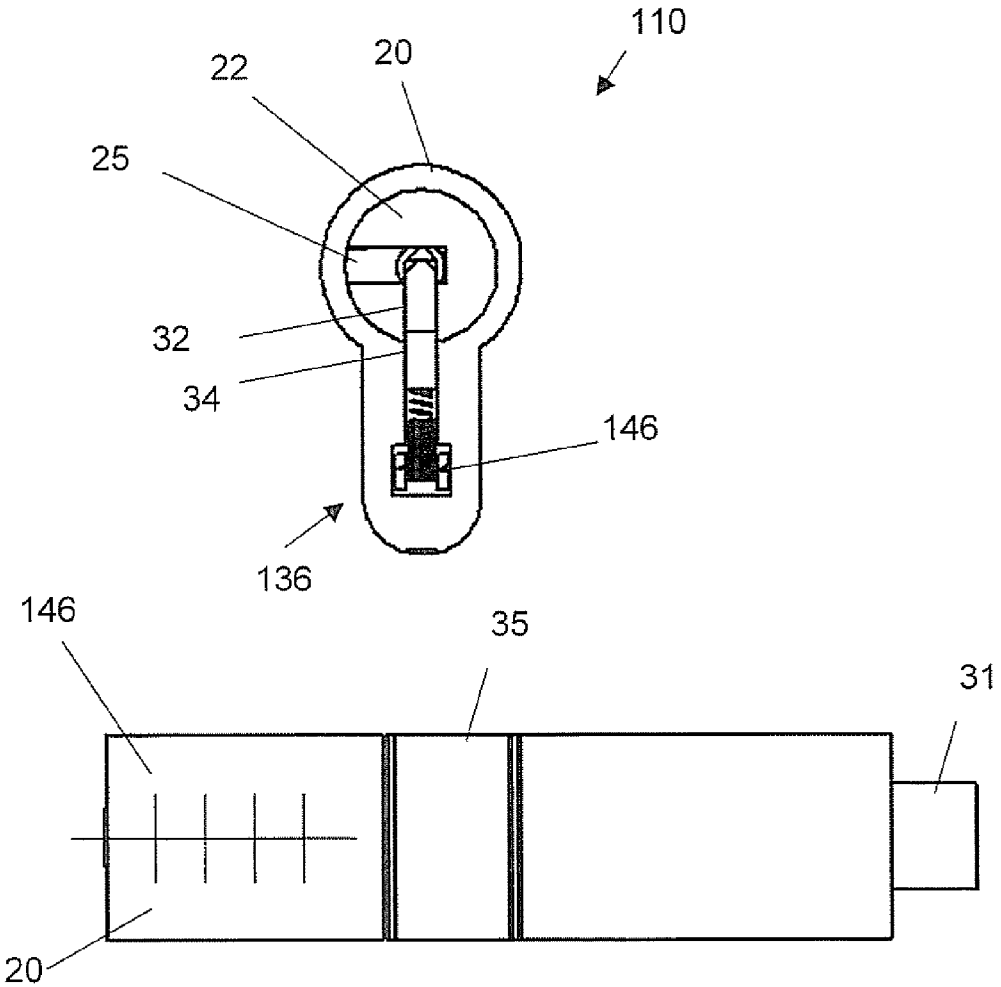
FIG. 4 is an end view and a cross sectional view of the cylinder lock of FIG. 3 with magnetic displacement of the pin-tumbler set, in accordance with an embodiment of the present invention.

Pin displacement mechanism 136 may alternatively comprise an electro-magnetic unit 146, as shown in FIG. 4. Driver pin displacement functionality of electro-magnetic unit 146 is generally similar to that described hereinabove for magnetic unit 138, except that respective electro-magnets remain stationary. Polarities of respective electro-magnets of electro-magnetic unit 146 may be changed and configured in a non-uniform configuration to obviate magnetic "picking" of cylinder lock 110, such as when an external magnetic field is applied to the cylinder, in an attempt to open the cylinder lock. Magnetic unit 138 includes connections (not shown in the figure) for operating the respective electro-magnets.

Figure 5A:
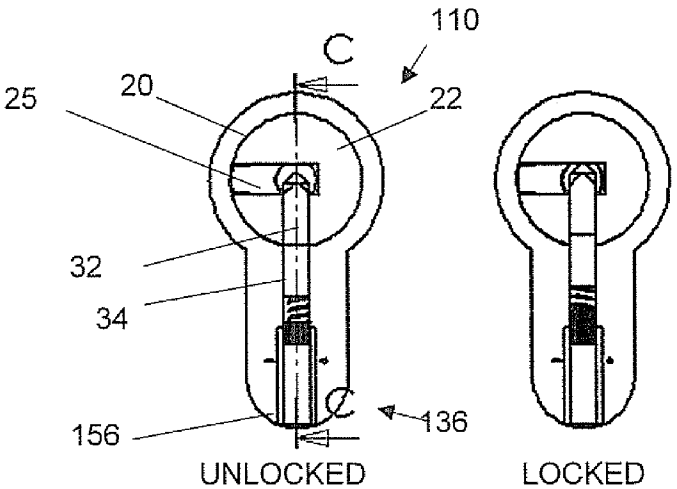
FIGS. 5A and 5B are end and cross sectional views, respectively of the cylinder lock of FIG. 3, with artificial muscle displacement of the pin-tumbler set showing an unlocked and locked state, respectively, in accordance with an embodiment of the present invention.
Figure 5B:
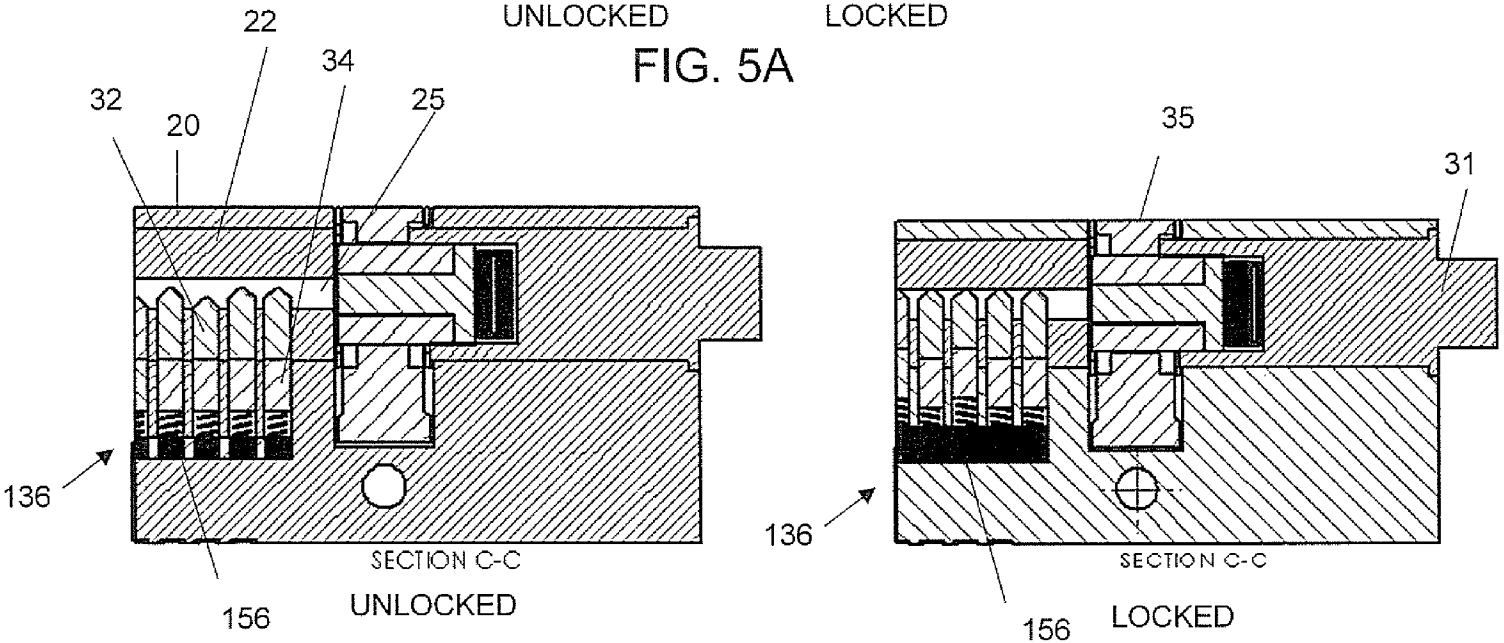

Another configuration of the pin displacement mechanism may be that of an artificial muscle unit 156, as shown in FIGS. 5A and 5B, showing respective locked and unlocked configurations of cylinder lock 110. Artificial muscle unit 156 may comprise one or more respective artificial muscles, which can individually displace one or more respective driver pins towards and away from slot 25. Artificial muscle unit 156 includes connections (not shown in the figure) for operation.

Pin displacement mechanism 136 may alternatively be a mechanical linkage 160, as shown in FIGS. 6A and 6C. In the example shown here, mechanical linkage 160 comprises: a pin driver arm 164, which is formed with tooth-like formation of respective plungers on one transverse edge of the arm, serving to contact corresponding driver pins; a linear driving arm 166 constrained to move generally parallel to the axis of cylindrical plug 22 and shaped to bear upon pin driver arm 164; and a linkage driver unit 167 which effects movement of linear driving arm 166.

Pin driver arm 164 and linear driving arm 166 are configured to enable controlled displacement of driver pins 34, enabling locking and unlocking, as described hereinbelow. Pin driver arm 164 is constrained to move only towards or away from slot 25, thereby displacing corresponding driver pins towards or away from slot 25. The opposite transverse edge of pin driver arm 164 facing linear driving arm 166 has one or more diagonally formed bearing surfaces 164*a*. Linear driving arm 166 has corresponding diagonal bearing surfaces 166*a* along its upper transverse surface to bear upon the surfaces of pin driver 164. Linkage driver unit 167 may comprise a linkage attached to a rotary motor, as shown in the figure. An alternative configuration for linkage driver unit 167 is a linear motor. Yet another alternative configuration for linkage driver unit 167 is an artificial muscle. Locked and unlocked configurations are shown in FIG. 6C.

Activation of pin displacement mechanism 136 as described hereinabove may be effected by direct wiring to a power and command unit outside of cylinder lock 110. Alternatively, power for the pin displacement mechanism operation may be obtained from at least one on-board battery and activation may be through a wireless means. One example of wired and wireless activation is through a small number pad located near cylinder lock 110.

The embodiments described hereinabove allow for opening cylinder lock 110 and rotating the cylinder plug with a matching key, in a manner similar to that of a prior art cylinder lock, if necessary. However, when no key is present in slot 25 and pin displacement mechanism 136 is commanded to open cylinder lock 110, there must be a means with which to similarly rotate cylindrical plug 22 and thereby open the door.

Reference is now made to FIGS. 6A-C, which are cross-sectional, representative, and cross sectional views, respectively, of the cylinder lock of FIG. 3, with a cylindrical plug rotational handle 169, in accordance with of an embodiment of the present invention. Rotational handle 169 is mechanically attached to the exterior edge of cylindrical plug 22. The rotational handle has a flattened wide shape and a hinge which allows rotational handle 169 to be deployed generally axially to cylinder lock 110, thereby enabling rotation of opened cylindrical plug 22 in a manner similar to that of when a key is inserted into the cylinder lock. When not in use, rotational handle 169 is stowed substantially perpendicularly to the longitudinal axis of cylinder lock 110, allowing access of a key to be inserted into slot 25.

Note that the slot in cylinder lock 110, as shown in the end views of FIGS. 3 and 4 and in FIG. 5A, extends radially from approximately the center of cylindrical plug 22 to the periphery of the cylindrical plug, presenting an opening of the slot facing body housing 20. As noted hereinabove, driver pins 34 and tumbler pins 32 move generally perpendicular to key 12, and likewise perpendicularly to slot 25. When a matching key is inserted into cylinder lock 110 (thereby displacing driver pins 34 and tumbler pins 32 to allow rotation of the plug as described hereinabove), the key is then rotated, thus rotating cylindrical plug 22. As cylindrical plug 22 is rotated, tumbler pins 32 are retained within the cylindrical plug by body housing 20 and driver pins 34 are retained in position within body housing 20 by the cylinder plug. Upon further rotation of cylinder plug, whereby slot 25 is presented to driver pins 34, driver 34 pins continue to be retained due to the presence of the key in the slot.

When no key is present in slot 25 and pin displacement mechanism 136 is commanded to displace driver pins 34 and tumbler pins 32 to allow rotation of the plug, cylindrical plug 22 may be rotated as described hereinabove. Upon further rotation of the cylindrical plug, the opening of slot 25 may be presented to driver pins 34. Although no key is present in the slot, driver pins 34 are nonetheless retained in position by pin displacement mechanism 136, as described hereinabove. However, if pin displacement mechanism 136 is presently commanded to displace driver pins 34 and tumbler pins 32 to disallow rotation of the plug, driver pins 34 may be undesirably driven into the opening of slot 25, thereby disrupting rotation of cylindrical plug 22. Similarly, when pin displacement mechanism 136 is commanded to displace driver pins 34 and tumbler pins 32 to allow rotation of the plug (i.e., with no key present, as described above), and following partial rotation of plug 22 (without the opening of slot 25 being presented to driver pins 34) displacement mechanism 136 may be presently commanded to displace driver pins 34 and tumbler pins 32 to disallow rotation of the plug. In this case, because driver pins 34 are retained in position within body housing 20 by the cylinder plug, rotation of the cylinder plug will still be allowed. Depending on the relative rotational position of the cylindrical plug, further rotation of the cylinder plug in this case will result in either engaging driver pins 34 with tumbler pins 32 (thereby disallowing rotation of the cylinder plug, as desired) or in driver pins 34 being undesirably driven into the opening of slot 25, thereby disrupting rotation of cylindrical plug 22 as noted hereinabove. A solution to the undesirable disruption of rotation is described hereinbelow.

Figure 7B:
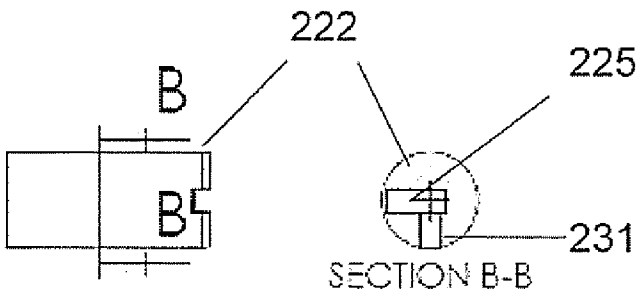
FIGS. 7A and 7B are schematic illustrations of a modified cylindrical plug and the key, in accordance with an embodiment of the present invention.
Figure 7A:
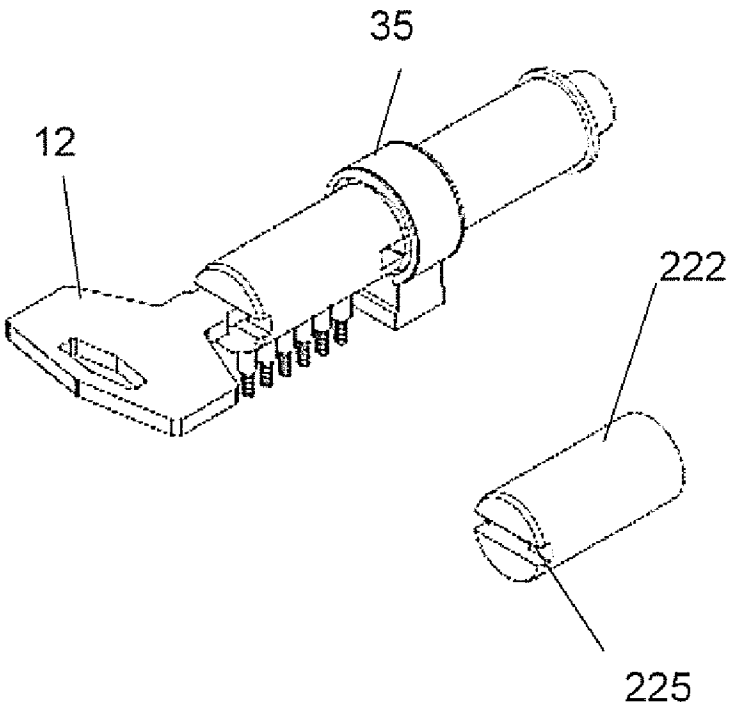

Reference is now made to FIGS. 7A and 7B, which are schematic illustrations of a modified cylindrical plug 222 and key 12, in accordance with an embodiment of the present invention. Note that modified cylindrical plug 222 is formed so that slot 225 does not present an opening at the periphery of the cylindrical plug, in contradistinction to the slot in cylindrical plug 22, as shown in the end views of FIGS. 3 and 4 and in FIG. 5A, as previously noted. Modified cylindrical plug 222 may be used in embodiments described hereinabove of cylinder lock 110, in place of cylindrical plug 22, thereby obviating the problem of disruption of rotation previously noted. Sectional view B-B of FIG. 7B further illustrates that slot 225 does not present an opening at the periphery of the cylindrical plug. Openings 231 are also shown in modified cylindrical plug 222, for passage of the driver pins and the pin-tumblers.

Reference is now made to FIGS. 8A-F, which are schematic illustrations of exemplary configurations of a modified cylindrical plug 222A and 222B—both having slot opening 26, an inhibitor 240 and 240A, and the respective inhibitors assembled onto the respective modified cylindrical plugs, of an embodiment of the present invention. Apart from difference described below, elements indicated by the same reference numerals of previous figures are generally identical in configuration and operation. In the configuration shown in FIGS. 8A-C cylindrical plug 222A has been machined or otherwise formed to reduce its diameter along much of it length to leave a ridge 238 along the length of the cylindrical plug and a. lip 239 at one end of the cylindrical plug. Inhibitor 240 is typically formed from a thin, strong, metallic material and comprises openings 241, which are formed to substantially match and align with openings 231, and a space 242, which is formed to substantially match and mate with ridge 238. The thickness of the material forming inhibitor 240 is chosen so that when the inhibitor is fitted onto cylindrical plug 222A, the periphery of the inhibitor, ridge 238, and lip 239 are all substantially flush. As shown in the FIGS. 8B and 8C, inhibitor 240 is formed to fit snugly about the periphery of cylindrical plug 222A and is maintained in position on the cylindrical plug by ridge 238, and lip 239.

Figure 8C:
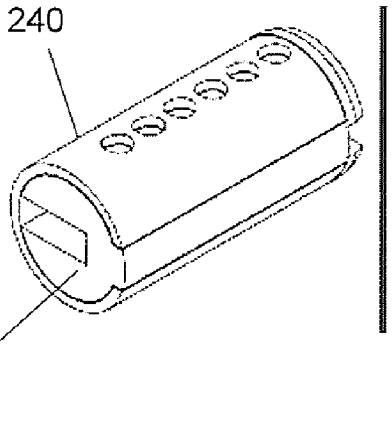
FIGS. 8A-F are schematic illustrations of exemplary configurations of a modified cylindrical plug, an inhibitor, and the inhibitor assembled onto the modified cylindrical plug, of an embodiment of the present invention.
Figure 8B:
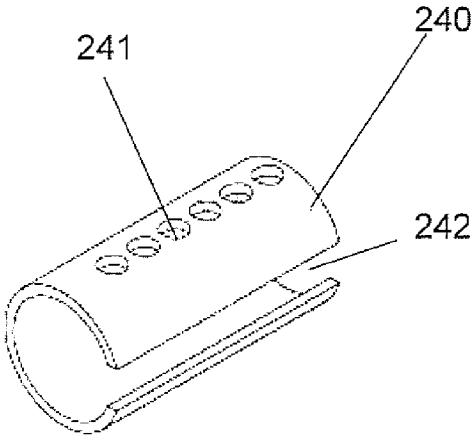
Figure 8A:
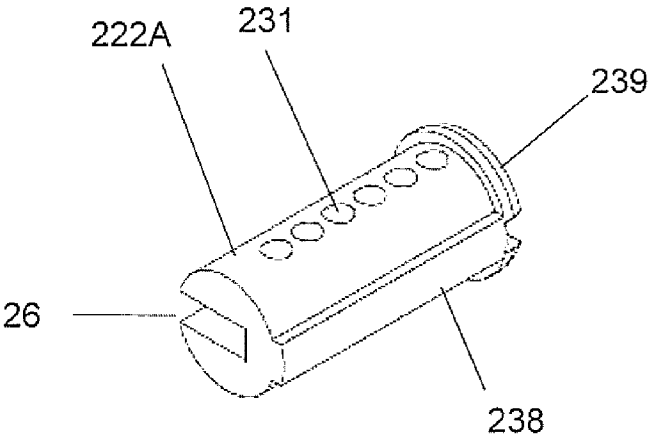
Figures 8D, 8E, 8F:
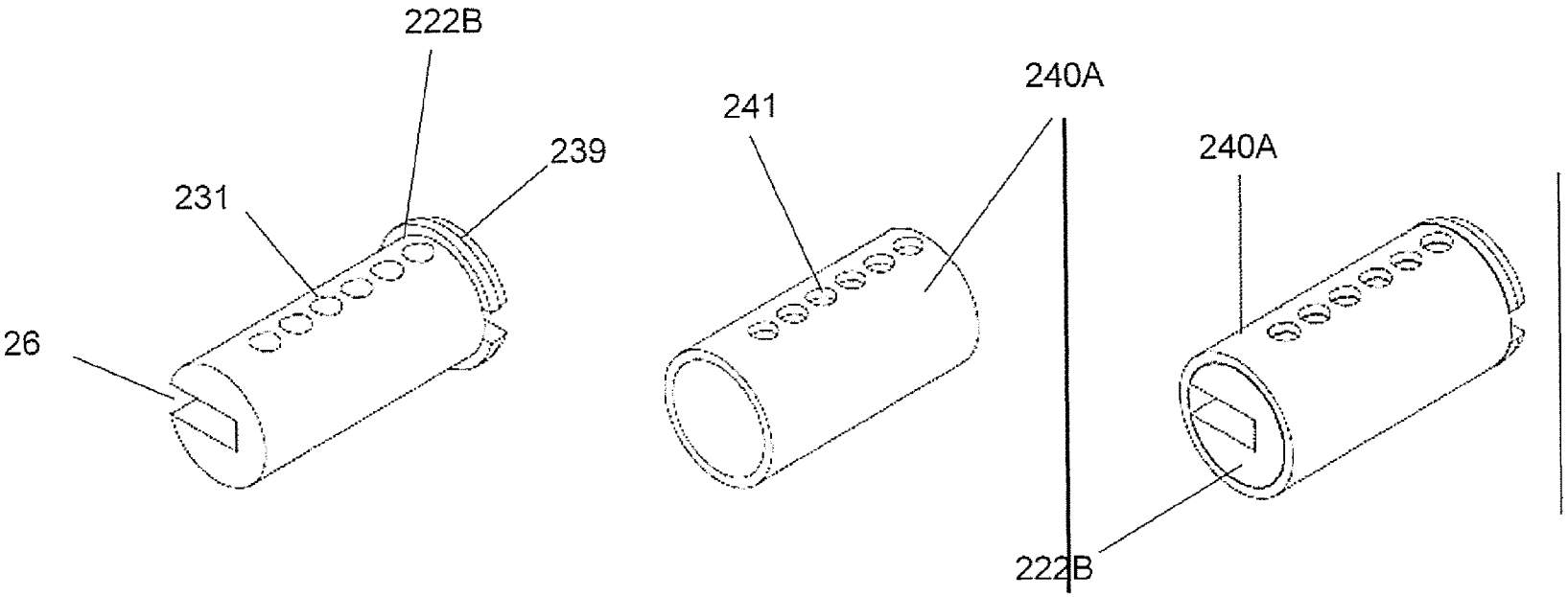

Referring to the configuration shown in FIGS. 8D-F, cylindrical plug 222B has been machined or otherwise formed to reduce its diameter along much of it length to leave a. lip 239 at one end. Inhibitor 240A is similar to inhibitor 240 described hereinabove except that inhibitor 240 without the space, presenting a complete peripheral surface. Inhibitor 240A is formed to fit snugly about the periphery of cylindrical plug 222A, having openings 241, which are formed to substantially match and align with openings 231. Inhibitor 240A is maintained in position on the cylindrical plug by lip 239.

It should be noted that any configuration similar to the configurations of modified cylindrical plugs 222A and 222B and inhibitors 240 and 240A, respectively, allowing effective covering of slot opening 26, while not inhibiting movement of driver pins 34 into and out of openings 231, and allowing substantially free rotation of the modified plug within the cylinder body serves to solve the problem of disruption of rotation described hereinabove.

As noted hereinabove, rotating tongue 35 (refer to FIGS. 2A, 3, 5B, and 6C) may be rotated by either of the cylindrical plugs when the cylinder lock is unlocked. The rotation may be controlled by means of a typical clutch mechanism, as known in the art. The control of rotation is advantageous, for example, in the case of a "blind cylinder", where the blind end of the cylinder lock is typically towards the "inside", meaning the side of the door which is not typically locked with a key. In the case of a conventional blind cylinder, the mechanism is designed to primarily allow rotation of the rotating tongue by the cylindrical plug from the inside, meaning the rotating tongue may be engaged when the cylinder lock is turned (unlocked) from the inside, even when the other cylindrical plug (outside) of the cylinder lock may be locked. When the outside cylindrical plug of a conventional cylinder lock is opened with a key, the key serves to engage the clutch mechanism so rotation of the rotating tongue by the cylindrical plug may be accomplished from the outside. However, because cylinder lock 110, as described above, may be opened without the use of key 12, a different clutch mechanism is employed, as described hereinbelow.

Figure 9B:
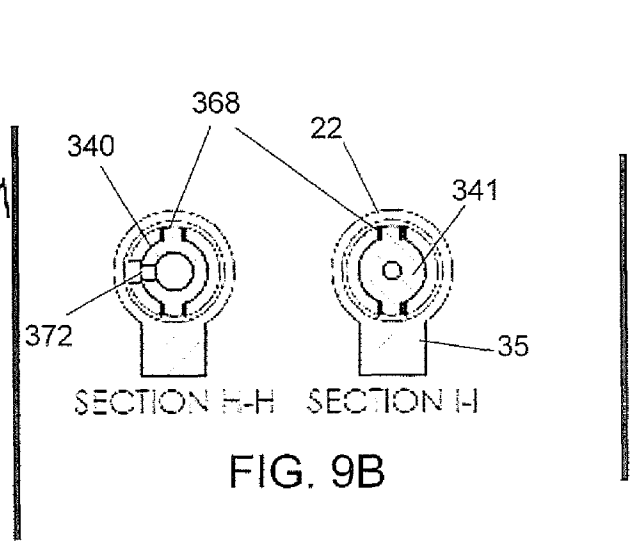
FIGS. 9A-C are top, side and sectional views, and isometric illustrations including partially sectional views, respectively of a cylinder lock a selector mechanism, in accordance with an embodiment of the present invention.
Figure 9C:
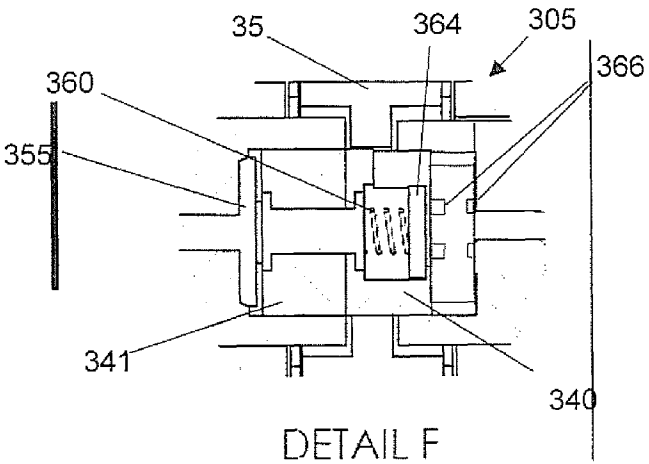
Figure 9A:
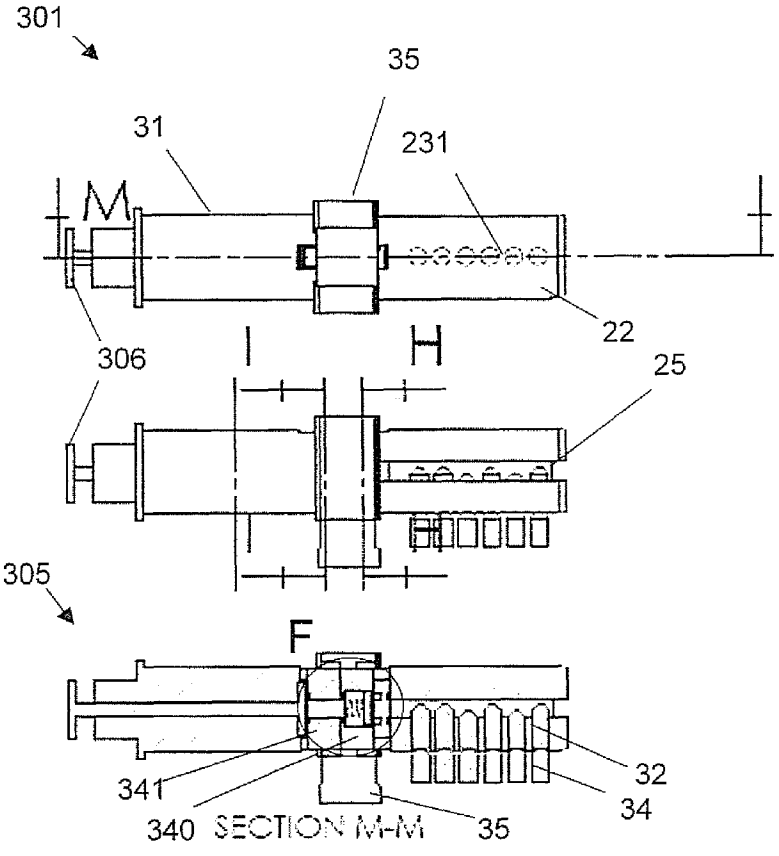
Figure 10:
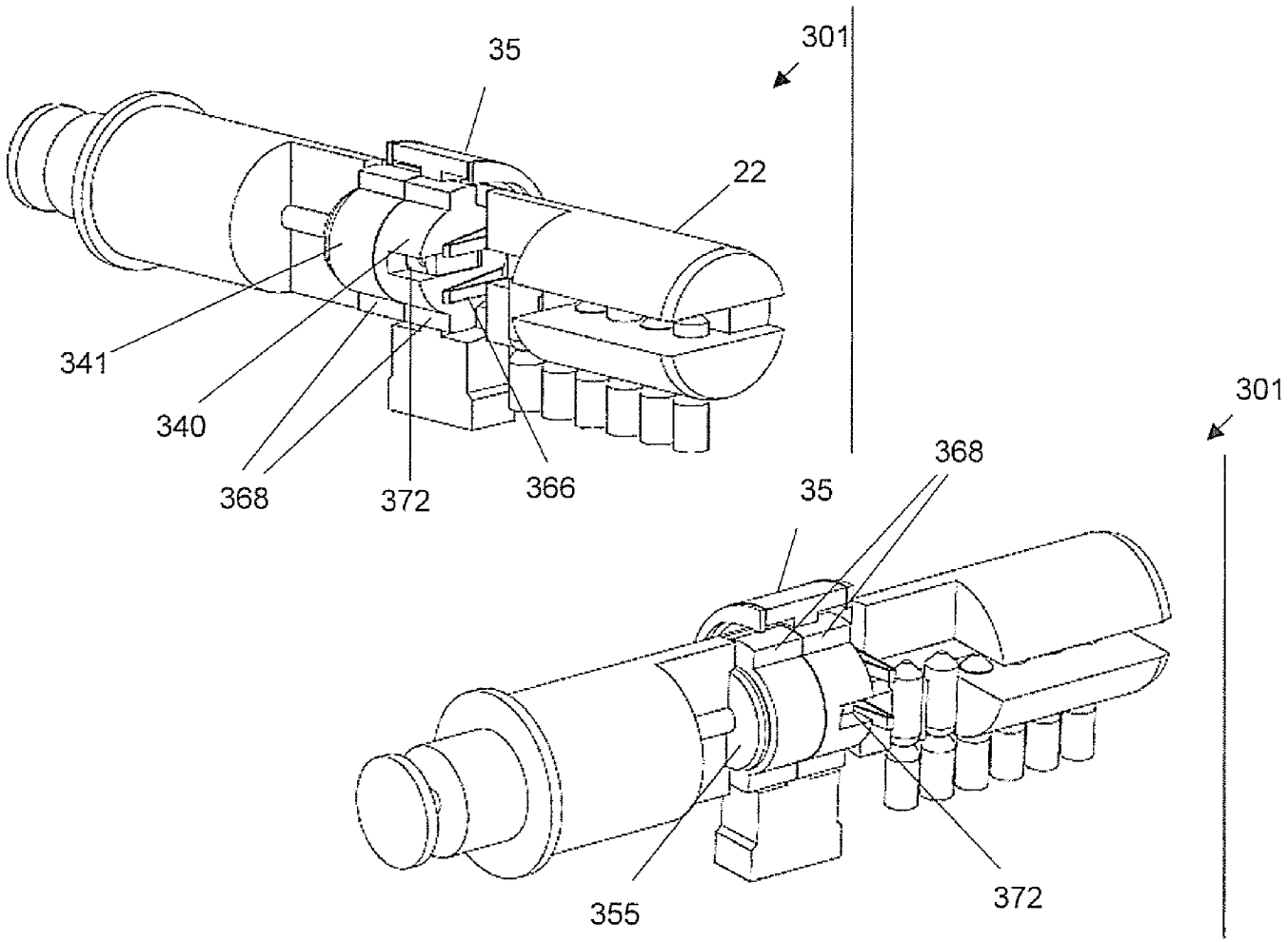
FIG. 10 are isometric illustrations including partially sectional views of the cylinder plugs and the selector mechanism of FIGS. 9A-C.

Reference is now made to FIGS. 9A-C and to FIG. 10, which are top, side, and detailed sectional views, and isometric illustrations including partially sectional views, respectively, of a cylindrical plug assembly 301 and a selector mechanism 305, in accordance with an embodiment of the present invention. Apart from differences described below, cylindrical plug assembly 301 comprises, inter alia, cylindrical plug 22 and second cylindrical plug 31, as shown in FIGS. 2-6, so that elements indicated by the same reference numerals in FIGS. 9A-C and FIG. 10 are generally identical in configuration and operation. Selector mechanism 305 functions to alternately allow rotation of rotating tongue 35 by plug 22 or by plug 31. Selector mechanism 305 comprises a selector plunger 306, a key-side drive block 340, a blind-side drive block 341, a selector plunger face plate 355, a coil spring 360, key bearing plate 364, and a leaf spring 366. Key-side drive block 340 and blind-side drive block 341 are positioned generally concentrically to rotating tongue 35, and they are radially constrained at the interior axial end of their respective plugs and may move in an axial direction, as indicated in FIGS. 9C and 10. Both drive blocks have two projecting drive tabs 368, oriented typically 180 degrees from one another, whose purpose is to engage and rotate rotating tongue 35. Leaf spring 366 serves to bias, key-side drive block 340 and blind-side drive block 341 towards the blind side of the cylinder lock (as shown in FIGS. 9A and 9C) so that if cylindrical plug 22 is open (i.e. the driver pins have been aligned to allow rotation of the cylindrical plug, as described in embodiments hereinabove and by using a matching key), key-side drive block 340 is normally engaged to allow rotation of the rotating tongue. If it is desired to engage and rotate rotating tongue 35 from the blind side of the cylinder lock, selector plunger 306 is depressed towards plug 31. Selector plunger face plate 355, which is connected to selector plunger 306, translates blind-side drive block 341 axially towards and against key-side drive block 340, which in turn compresses leaf spring 366. The resultant axial translation of blind-side drive block 341 engages it to allow rotation of the rotating tongue by cylindrical plug 31. At the same time, key-side drive block 340 is disengaged. Selector plunger 306 may activated manually, as described hereinabove, and it may be activated by electronic means, such as a motor, in which case it may also be commanded remotely, such as by a wire or wireless connection.

Selector mechanism 305 may be operated so that the selector plunger is depressed and plug 31 rotates the rotating tongue. However, if the selector plunger is released before the engaged blind-side drive block 341 is returned to its initial axial orientation, it is possible that the selector mechanism may be inadvertently held in a configuration with blind-side block 341 engaged, thereby disengaging key-side block 340. Should it then be desirable to engage key-side block 340, it would not be possible to do this due to the preload of the leaf spring, maintaining blind-side block 341 in its engaged position.

A solution to this problem is afforded by the structure of key-side block 340, as shown in FIGS. 9B and 9C and 10. Block slot 372 extends radially from the periphery of key side block 340, positioned typically 90 degrees from the projecting drive tabs, as shown. The block slot is formed to align with slot 25. When the key is inserted into slot 25, in addition to serving to allow rotation of the cylindrical plug as described hereinabove, the end of the key enters the block slot and bears upon key bearing plate 364, which is preloaded by coil spring 360, serving to urge key-side block 340 against blind-side block 341. Rotation of the key presently serves to rotate both key-side block 340 and blind-side block 341. The blind-side block may thereby be disengaged by rotating the key back and forth as necessary, typically approximately 30 degrees in each direction. Following this, key side block 340 is engaged and may rotate rotating tongue as described hereinabove.

Whereas the cylindrical plug assembly shown in FIGS. 3-10 has tumbler pins 32 and driver pins 34 and a blind end, embodiments described hereinabove are likewise applicable for a cylindrical plug with tumbler and driver pin sets at both ends, mutatis mutandis. Whereas references hereinabove have been made to a cylinder lock as typically used in a door, embodiments of the current invention are likewise applicable to any configuration wherein a cylinder lock is typically applied. Such configurations may include, but are not limited to: drawers, windows, safes, gates, etc.

It will be appreciated that the above descriptions are intended only to serve as examples, and that many other embodiments are possible within the scope of the present invention as defined in the appended claims.

What is claimed is:

1. A cylinder lock device comprising:

a body housing having a bore, with a direction of elongation defining an axial direction for the device;

a first rotatable cylindrical plug in the bore, the plug having an axially extending key slot from at least one end of the plug;

a plurality of driver pins configurable substantially perpendicular to the key slot, located within the body housing and substantially outside of the plug, and displaceable partially into and from the plug;

a plurality of tumbler pins corresponding to and positionable substantially collinear with each one of the plurality of driver pins and substantially inside the plug, the tumbler pins displaceable by a key to bias the driver pins to enable rotation of the plug, the driver pins adapted to displace the respective tumbler pins; and a displacement mechanism being deployed within the body housing and adapted to displace the plurality of driver pins thereby selectively enabling rotation of the plug when no key is present in the slot, the displacement mechanism not including a spring that moves the displacement mechanism, the displacement mechanism not including any key and the displacement mechanism further including (i) a pin driver arm formed with tooth-like plungers to contact corresponding driver pins, (ii) a linear driving arm and (iii) a linkage driver unit.

2. A lock device according to claim 1, wherein the key slot extends substantially radially to the side of the plug, forming a lateral opening in the plug and wherein the cylinder lock further comprises a fitted inhibitor adapted to cover the lateral opening so that the plurality of driver pins do not enter the lateral opening and thereby do not serve to inhibit disruption of rotation of the rotatable cylindrical plug.

3. A lock device according to claim 1, wherein the displacement mechanism is adapted to controllably displace the plurality of driver pins between a first state in which the plurality of driver pins are biased towards the key slot to provide a locked state and a second state in which the plurality of driver pins are aligned to allow rotation of the cylindrical plug.

4. A lock device according to claim 1, wherein the displacement mechanism includes a first artificial muscle unit adapted to selectively displace the respective plurality of driver pins.

5. A lock device according to claim 1, wherein the linkage driver unit is selected from the group consisting of: a second artificial muscle unit; a linear motor assembly, a rotational motor assembly, and an electromagnetic assembly.

6. A lock device according to claim 1, further comprising:

a rotatable tongue positionable substantially axially with and at the interior end of the first rotatable plug and having a clutch enabling the rotatable tongue to rotate with the first plug;

a second rotatable cylindrical plug in the bore, the clutch enabling the rotatable tongue to rotate with the second plug; and a selector mechanism adapted to selectively engage and disengage the clutch when a key is present in the slot and when no key is present in the slot, the selector mechanism being adapted to engage the clutch, enabling the rotatable tongue to rotate with the first plug.

7. A lock device according to claim 6, wherein the selector mechanism is further adapted to engage the clutch and to enable rotation of the first rotatable plug when a key is present in the slot, after the rotatable tongue has been rotated by the second plug.

8. A lock device according to claim 6, wherein the selector mechanism is mechanically actuable.

9. A cylinder lock device comprising:

a body housing having a bore, with a direction of elongation defining an axial direction for the device;

a rotatable cylindrical plug in the bore, the plug having an axially extending key slot from at least one end of the plug;

a mechanically accessible handle permanently mechanically linked to the plug at the end of the plug having the slot, the handle adapted to rotate the plug when the plug is freed to rotate and when no key is present in the slot; wherein the handle is adapted to allow insertion and removal of a key from the slot and wherein the handle is further adapted to be hinged, so that the handle is stowable substantially perpendicular to the axis of the plug and deployable substantially parallel to the axis of the plug;

a plurality of driver pins configurable substantially perpendicular to the key slot, located within the body housing and substantially outside of the plug, and displaceable partially into and from the plug;

and a displacement mechanism deployed within the body housing and adapted to displace the plurality of driver pins thereby selectively enabling rotation of the plug when no key is present in the slot, the displacement mechanism not including a spring that moves the displacement mechanism, the displacement mechanism not including any key.

10. A method of forming a cylinder lock device comprising the steps of:

forming a bore in a body housing of the cylinder lock device, the body housing having a direction of elongation defining an axial direction for the device;

inserting a first rotatable cylindrical plug in the bore, the plug having an axially extending key slot from at least one end of the plug;

configuring a plurality of tumbler pins in the plug, whereby a key displaces the tumbler pins to enable rotation of the plug;

positioning a plurality of driver pins, corresponding to and substantially collinear with each one of the plurality of tumbler pins and locatable distally from the slot and from the plurality of tumbler pins, adapted to displace the respective tumbler pins; and deploying a displacement mechanism within the body housing to displace the plurality of driver pins thereby enabling or disabling rotation of the plug when no key is present in the slot, the displacement mechanism not including a spring that moves the displacement mechanism and the displacement mechanism not including any key, and the displacement mechanism further including (i) a pin driver arm to contact corresponding driver pins, (ii) a linear driving arm and (iii) a linkage driver unit.

11. A method of forming a cylinder lock device according to claim 10, further comprising the steps of:

positioning a rotatable tongue substantially axially with and at the interior end of the first rotatable plug, and having a clutch enabling the rotatable tongue to rotate with the first plug;

inserting a second rotatable cylindrical plug in the bore, the clutch enabling the rotatable tongue to rotate with the second plug; and configuring a selector mechanism to selectively engage and disengage the clutch when a key is present in the slot and when no key is present in the slot, the selector mechanism selectively engaging the clutch, enabling the rotatable tongue to rotate with the first plug.

* * * * *